US011834788B2

(12) United States Patent
Adamsson et al.

(10) Patent No.: US 11,834,788 B2
(45) Date of Patent: Dec. 5, 2023

(54) CRESCENT FORMER FOR PRODUCING TISSUE PAPER

(71) Applicant: VALMET AB, Sundsvall (SE)

(72) Inventors: Karl Adamsson, Karlstad (SE); Stefan Söderberg, Forshaga (SE); Stefan Karlsson, Karlstad (SE)

(73) Assignee: VALMET AB, Sundsvall (SE)

( * ) Notice: Subject to any disclaimer, the term of this patent is extended or adjusted under 35 U.S.C. 154(b) by 0 days.

(21) Appl. No.: 18/006,589

(22) PCT Filed: Aug. 27, 2021

(86) PCT No.: PCT/EP2021/073695
§ 371 (c)(1),
(2) Date: Jan. 24, 2023

(87) PCT Pub. No.: WO2022/048993
PCT Pub. Date: Mar. 10, 2022

(65) Prior Publication Data

US 2023/0212819 A1 Jul. 6, 2023

(30) Foreign Application Priority Data

Sep. 4, 2020 (SE) ..... 2051044-2

(51) Int. Cl.
*D21F 1/32* (2006.01)
*D21F 9/00* (2006.01)
(Continued)

(52) U.S. Cl.
CPC ..... *D21F 1/32* (2013.01); *D21F 1/02* (2013.01); *D21F 3/04* (2013.01); *D21F 3/08* (2013.01); *D21F 5/181* (2013.01); *D21F 9/003* (2013.01)

(58) Field of Classification Search
CPC . D21F 9/00; D21F 9/003; D21F 11/00; D21F 11/14; D21F 11/145; D21F 11/006;
(Continued)

(56) References Cited

U.S. PATENT DOCUMENTS 3,691,010 A 9/1972 Krake

FOREIGN PATENT DOCUMENTS

CN 106812015 A 6/2017
DE 102 55 471 * 7/2004 ..... D21F 9/003
(Continued)

OTHER PUBLICATIONS

DE 102 55 471, English language machine translation. (Year: 2004).*

(Continued)

*Primary Examiner* — Eric Hug
(74) *Attorney, Agent, or Firm* — Alston & Bird LLP

(57) ABSTRACT

The present invention relates to a crescent former for producing tissue paper, the former comprising a forming section (A), a press section (B) and a drying section (C), wherein the crescent former further comprises a felt fabric (41) for carrying the stock from the forming nip (15) of the forming section (A) to the press nip (22) of the press section (B), and the felt fabric (41) being configured to carry the stock to the press nip (22) where the stock is transferred to the drying section (C), wherein further the felt fabric (41) is configured to be returned from the press nip (22) to the forming nip (15) in a return section (D) such that the felt fabric (41) forms an endless loop, wherein the return section (D) comprises a cleaning station (42), of which at least a part is arranged in a negative machine direction (–MD) in relation to a center line (R) of the forming roll (12).

18 Claims, 2 Drawing Sheets

(51) Int. Cl.

| | |
|---|---|
| ***D21F 1/02*** | (2006.01) |
| ***D21F 3/04*** | (2006.01) |
| ***D21F 3/08*** | (2006.01) |
| ***D21F 5/18*** | (2006.01) |

(58) Field of Classification Search
CPC ... D21F 1/32; D21F 1/34; D21F 1/325; D21F 1/345; D21F 5/181
See application file for complete search history.

(56) References Cited

FOREIGN PATENT DOCUMENTS

| | | | |
|---|---|---|---|
| GB | 1030900 | A | 5/1966 |
| WO | WO-2009/067066 | A1 | 5/2009 |

OTHER PUBLICATIONS

International Search Report and Written Opinion for International Application No. PCT/EP2021/073695, dated Dec. 23, 2021, (10 pages), European Patent Office, Rijswijk, Netherlands.

* cited by examiner

CRESCENT FORMER FOR PRODUCING TISSUE PAPER

CROSS REFERENCE TO RELATED APPLICATIONS

This application is a National Stage Application, filed under 35 U.S.C. § 371, of International Application No. PCT/EP2021/073695, filed Aug. 27, 2021, which international application claims priority to and the benefit of Swedish Application No. 2051044-2, filed Sep. 4, 2020; the contents of both of which as are hereby incorporated by reference in their entireties.

BACKGROUND

Related Field

The present invention relates to a crescent former for producing tissue paper, the crescent former comprising a forming section, a press section and a drying section.

Description of Related Art

Crescent formers are commonly used for producing tissue paper and typically comprise a forming section, a press section and a drying section. In the forming section, a stock with a high moisture content is applied to a forming fabric in a forming nip and is transported to a press nip where the stock is transferred to a drying section that generally comprises a Yankee cylinder for drying the stock to produce a tissue paper.

Although crescent formers are efficient and reliable, producing tissue paper in this way requires a lot of space and this is especially cumbersome when retrofitting new components in existing crescent formers or when replacing an older former with a new. Due to the complexity of the process for producing paper, it is not straightforward to alter the function or design of the crescent former while at the same time maintaining the operational stability and the desired quality of the produced tissue paper. At present, there are no prior art solutions that allow for significantly space saving solutions.

There is therefore a need for further developments within this area.

BRIEF SUMMARY

The object of the present invention is to eliminate or at least to minimize the problems discussed above. This is achieved by a crescent former according to the appended independent claims.

The crescent former according to the present invention comprises a forming section, a press section and a drying section, wherein the forming section comprises a breast roll and a forming roll, a forming wire, and a headbox for injecting stock into a forming nip formed between the breast roll and forming roll. The press section comprises a press roll and the drying section comprises a Yankee roll arranged to form a press nip with the press roll of the press section, wherein the press nip is arranged in a positive machine direction from the forming nip. Furthermore, the crescent former comprises a felt fabric for carrying the stock from the forming nip to the press nip, and the felt fabric is configured to receive stock from the headbox and to be pressed against the forming wire in the forming nip. The felt fabric is further configured to be separated from the forming wire after the forming nip and to carry the stock to the press nip where the stock is transferred to the Yankee roll. Also, the felt fabric is configured to be returned from the press nip to the forming nip in a return section such that the felt fabric forms an endless loop, and the return section comprises a cleaning station such that at least part of the cleaning station is arranged in a negative machine direction in relation to a center line of the forming roll, said negative machine direction being a direction that is opposite to the positive machine direction.

By configuring the crescent former such that at least part of the cleaning station is arranged in a negative machine direction in relation to the center of the forming roll, a significantly more compact crescent former is achieved. This allows for a shorter total length of the crescent former resulting in a significantly more cost-efficient crescent former because of the smaller space required. However, operation of the crescent former is still as efficient and reliable as with prior art formers so that the present invention does not risk decreasing production speed or lessening quality of the finished tissue paper.

Suitably, the felt fabric is arranged to pass above the breast roll and the headbox on an upper level of the former in the return section when returning from the press nip to the forming nip. Thereby, the cleaning station may be placed above the forming section and transport of the felt fabric to the cleaning station is facilitated.

Also, the return section may comprise a stretcher station, said stretcher station being arranged in a negative machine direction in relation to a center line of the forming roll of the forming section. Thereby, the total length of the crescent former may further be decreased and a combination of the stretcher station with at least part of the cleaning station may be achieved so that an even more compact and efficient crescent former may be created.

Suitably, the crescent former also comprises a tray for collecting water from the stretcher station, said tray being arranged below the stretcher station but above the forming roll. Thereby, liquid and fibers that are removed from the felt fabric can be prevented from ending up on other parts of the crescent former. More particularly, the forming wire may be protected from such liquid and fibers so that the forming wire may be kept clean and contaminations to the stock in the forming section can be prevented. This is particularly advantageous in preventing spots or streaks in the finished tissue paper that originates from such contaminations, so that a high quality of the end product may be achieved.

The crescent former may also comprise a first lead roll for leading the felt fabric from the press nip towards the cleaning station. Thereby, the felt fabric may be directed to proceed above the forming section and reach the cleaning station without contacting the press section, forming section or drying section on its way from the press nip to the cleaning station. Suitably, the crescent former also comprises a second lead roll for leading the felt fabric from the first lead roll towards the cleaning station, wherein the first lead roll contacts a paper side of the felt fabric and the second lead roll contacts a back side of the felt fabric. This further improves guiding the felt fabric from the press nip to the cleaning station so that the felt fabric is efficiently transported without risking coming into undesired contact with any other part of the crescent former.

Furthermore, the crescent former suitably comprises a cover arranged to at least partly enclose the cleaning station for preventing washing liquid from escaping from the washer. This is advantageous in preventing liquid and fibers that are removed from the felt fabric during the wash from contacting other parts of the crescent former and also from ending up on floors or other parts of the space in which the crescent former is arranged. This in turn aids in preventing damage and in decreasing the risk of accidents for personnel working around or near the crescent former.

Many additional benefits and advantages of the present invention will be readily understood by the skilled person in view of the detailed description below.

BRIEF DESCRIPTION OF THE FIGURES

The invention will now be described in more detail with reference to the appended drawings, wherein FIG. 1 discloses a crescent former according to the prior art in a view from the side.

Figure 1:
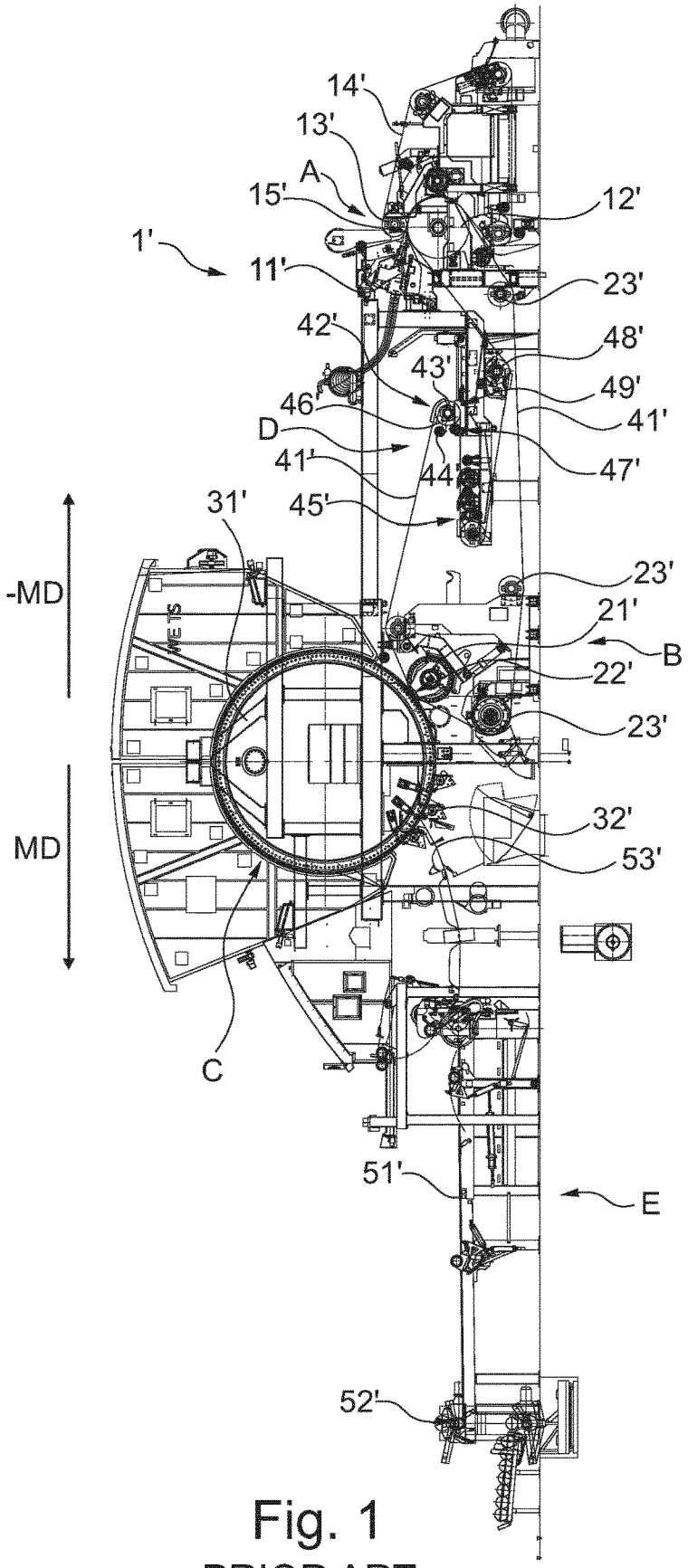
Fig. 1 PRIOR ART

All the figures are schematic, not necessarily to scale, and generally only show parts which are necessary in order to elucidate the respective embodiments, whereas other parts may be omitted or merely suggested. Any reference number appearing in multiple drawings refers to the same object or feature throughout the drawings, unless otherwise indicated.

DETAILED DESCRIPTION OF VARIOUS EMBODIMENTS

In the following, a crescent former 1' according to the prior art will be described with reference to FIG. 1, followed by a description of a crescent former according to a preferred embodiment of the present invention with reference to FIG. 2. This serves to clearly distinguish the invention and its contribution to the state of the art, and where components of the invention are similar to those of the prior art they will be denoted by similar reference numerals distinguishing the prior art by a prime symbol.

When the terms "before" and "after" are used herein, this is to be interpreted as upstream and downstream, respectively, with regard to a moving part of the crescent former 1, 1'. For tissue paper being produced in the crescent former 1, 1' this means that "before" refers to a part of the manufacturing of the tissue paper where a given part of a web passes before it reaches another part that is to be seen as "after", i.e. that "before" relates to something that is upstream from something else in view of the movement of the web. For a fabric such as a forming wire or a felt fabric "before" refers to a point where a given point on the fabric is located at a first point in time whereas "after" refers to a point where the same point on the fabric is located at a second point in time, the second point in time being after the first point in time but before the fabric has completed an entire revolution and again reached the point where it was at the first point in time. For a crescent former, this means that the felt fabric passes the press section after the forming section but before the return section.

Thus, FIG. 1 discloses a crescent former 1' according to the prior art where tissue paper is produced by injecting stock from a headbox 11' into a forming nip 15' to form a web and passing the web on a first fabric 41' that is also referred to as a felt fabric from a forming section A to a press section B where the stock is transferred to a Yankee roll 31' of a drying section C in a press nip 22'. The Yankee roll may also be referred to as a Yankee cylinder or a Yankee dryer. After being removed from the Yankee roll 31' by a creping blade 32', the web or tissue paper 51' may proceed through additional treatment steps 51' in a dry end section E before being wound on a reel 52' to form a finished product.

In the prior art crescent former 1', the web is formed in the forming nip 15' by the stock comprising a mixture of water and fibers being ejected at high speed from the headbox 11' and trapping the ejected stock between the felt fabric 41' and a second fabric 14' or forming wire 14'. The forming wire 14' forms an endless loop in the forming section A. The forming nip 15' is formed between a forming roll 12' and a breast roll 13' and the forming wire 14' is separated from the felt fabric 41' after the forming nip 15' and cleaned before returning to the forming nip 15'.

In the press section B, the felt fabric 41' is lead to the press nip 22' by a series of lead rolls 23', and the press nip 22' itself is formed by a press roll 21' and the Yankee cylinder 31' of the drying section C.

The felt fabric 41' forms an endless loop from the forming nip 15' of the forming section A to the press nip 21' of the press section B and through a return section D back to the forming nip 15'. In the return section D, the felt fabric 41' is cleaned in a cleaning station 42' that comprises a felt stretcher roll 43' and a cleaning shower 44' that sprays a washing fluid into a wash nip 46' formed between the felt fabric 41' and the felt stretcher roll 43'. Following the felt stretcher roll 43' where washing fluid is pressed into the felt fabric 41' a high pressure water cleaning shower 47' sprays washing fluid on a paper side of the felt fabric 41' and a plurality of suction boxes 45' are arranged after the cleaning shower 47' to dewater the felt fabric 41' and remove any remaining fibers from the web that could remain stuck to the felt fabric 41' after the web has been transferred to the Yankee cylinder 31' in the press nip 22'. The felt fabric 41' is then rendered clean and is returned to the forming nip 15' by lead rolls 48'. Also provided in the return section D is a stretcher station 49' that is generally arranged together with the felt stretcher roll 43' and that serves to stretch the felt fabric 41' to achieve an even tension. In some crescent formers, the stretcher station 49' is separated from the washing station 42' but they are generally arranged to wash and stretch the felt fabric 41' after the web has been transferred to the drying station C but before the felt fabric 41' is returned to the forming nip 15'.

In the crescent former 1', a positive machine direction MD or simply machine direction MD is defined as a direction from the forming section A to the drying section C, so that the web travels in the positive machine direction MD as it proceeds through the crescent former 1' form the forming nip 15' to the drying section C and onwards to the dry end section E. A negative machine direction −MD is then a direction that is opposite to the machine direction MD. A length of the crescent former 1' is defined as a distance from one end of the crescent former 1' to another end of the crescent former 1' in the dry end section E. Typically, the length of a crescent former 1' according to the prior art is about 34 m and a height of the crescent former 1' from a floor on which the crescent former 1' stands to a highest point of the crescent former 1' is about 10-11 m. The highest point is generally in the drying section C.

The present invention will now be described with reference to FIG. 2. As already mentioned above, parts of the crescent former 1 that are similar in form and/or function to the prior art crescent former 1' will be denoted by the same terms and reference numerals.

Figure 2:
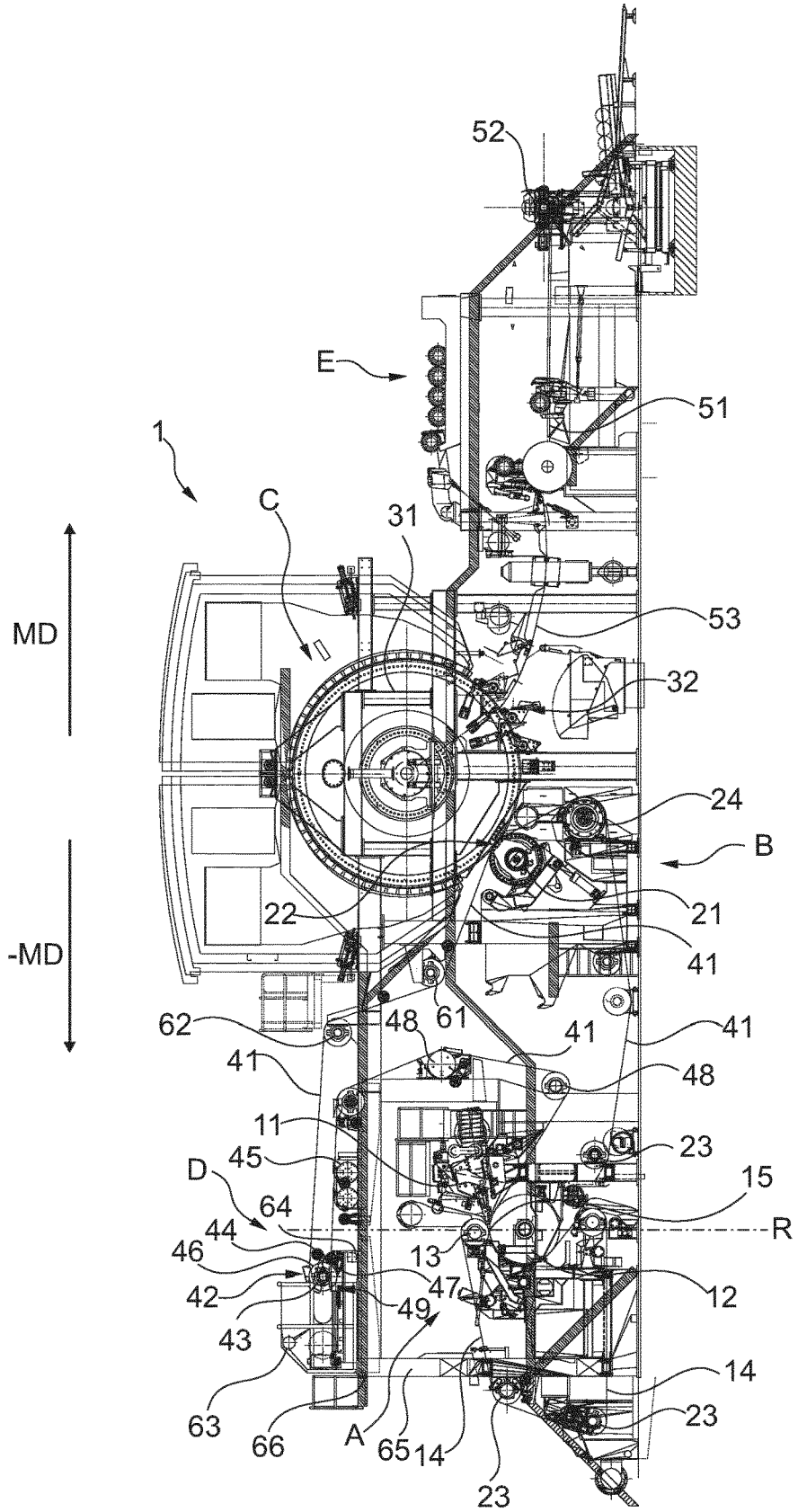
FIG. 2 discloses a crescent former according to the present invention in a view from the side.

In FIG. 2, the web passes in the positive machine direction from left to right, whereas each point on the forming wire 14 performs a clockwise revolution from the forming nip 15 and over lead rolls 23 in order to return again to the forming nip 15. Each point on the felt fabric 41 in turns perform a counterclockwise movement from the forming nip 15 to the press nip 22 and from the press nip 22 to the washing station 42, before turning to move clockwise from the washing station 42 via lead rolls 48 to the forming nip 15. It is to be noted that the crescent former 1 of FIG. 2 could instead be mirrored so that the web, the forming wire 14 and the felt fabric 41 instead move in the opposite directions and it is to be readily understood by the skilled person that such mirroring would provide essentially the same configuration and technical effects as the crescent former 1 now shown in FIG. 2.

In the forming section A, stock is ejected from the headbox 11 into the forming nip 15 formed between the forming roll 12 and the breast roll 13. The stock forms a web between the first fabric 41 or felt fabric 41 and the forming wire 14 in the forming nip 15 and the forming wire 14 is separated from the web and the felt fabric 41 after the forming nip 15. The forming wire 14 is then returned in an endless loop to the forming nip 15 and may undergo a cleaning during its return.

The felt fabric 41 carrying the web is lead on lead rolls 23 and proceeds from the forming section A to the press section B and enters the press nip 22 that is formed between the press roll 21 and the Yankee roll 31 of the drying section C. Before reaching the press nip 22, the felt fabric 41 also passes a dewatering roll 24 that may also be referred to as a suction roll and that dewaters the web before it arrives at the press nip 22. After the press nip 22, the web is transferred to the Yankee roll 31 and is dried before being removed from a surface of the Yankee roll 31 by the creping blade 32. The web or tissue paper 53 then proceeds in the dry end section E to reach the reel 52 in a manner similar to that of the prior art crescent former 1' of FIG. 1.

The present invention differs from the prior art mainly in configuration and operation of the return section D where the felt fabric 41 is treated during its return from the press nip 22 to the forming nip 15. Thus, after the press nip 22 the felt fabric 41 is lead to the cleaning station 42 that is arranged at least in part in the negative machine direction −MD in relation to a center line R of the forming roll 12. Thereby, a more compact crescent former 1 is achieved since the return section D is not placed entirely between the forming section A and the press section B but instead above the forming section A so that space in and around the crescent former 1 is more efficiently used. The total length of the crescent former 1 according to the invention is in this preferred embodiment only about 27 m but may in other embodiments be even shorter. At the same time, the height of the crescent former 1 remains essentially the same as for the prior art crescent former 1' at about 10-11 m due to the return section D even when placed above the forming section A not extending higher than the drying section C of a conventional crescent former 1'.

Thus, in the preferred embodiment of FIG. 2, the felt fabric 41 is lead to the return section D from the press nip 22, optionally being lead by a first lead roll 61 and/or a second lead roll 62 to reach an upper level of a holding structure 65 on which the return section D is at least partly arranged. It is advantageous to provide the lead rolls 61, 62 in order to further provide a crescent former 1 with a shorter length than known from the prior art. Suitably, the first lead roll 61 contacts the felt fabric 41 on a paper side and the second lead roll 62 contacts the felt fabric 41 on a back side in order to achieve a compact and efficient way of leading the felt fabric 41 to the washing station 42. By arranging the first lead roll 61 and the second lead roll 62 as shown in FIG. 2 with the first lead roll contacting the felt fabric 41 on the paper side and the second lead roll contacting the felt fabric 41 on the back side or roll side a particularly compact and efficient leading of the felt fabric 41 to the return section D is achieved. This allows for the felt fabric 41 to be brought up to the second level 66 of the holding structure 65 in an angle steeply upwards after the first lead roll 61 and to turn into an essentially horizontal direction after the second lead roll 62 such that the felt fabric 41 reaches the cleaning station 42 substantially horizontally. Alternatively, the felt fabric 41 may reach the cleaning station 42 at an angle to a horizontal direction.

Similar to the prior art, the washing station 42 may comprise the cleaning shower 44 followed by the felt stretcher roll 43 and the wash nip 46 formed with the felt fabric 41 against said felt stretcher roll 43. At the felt stretcher roll 43, the felt fabric 41 is suitably turned so that it changes its direction of movement from the negative machine direction −MD to the positive machine direction MD, and after turning on the felt stretcher roll 43 the felt fabric 41 may be subjected to a cleaning shower 47 followed by a plurality of suction boxes 45. The suction boxes or vacuum boxes 45 may be Uhle boxes but other means for generating vacuum may also be used as is well known within the art. It is to be noted that the washing station 42 may comprise only some of the components mentioned herein and that additional cleaning may also be performed by additional components of the washing station as long as they are able to remove remains of the web from the felt fabric 41 so that it is rendered fit for receiving stock again at the forming nip 15.

According to the invention, at least part of the washing station 42 is placed in a negative machine direction −MD in relation to a center line R extending in a vertical direction through the forming roll 12, and suitably at least the felt stretcher roll 43 and components arranged immediately in connection with the felt stretcher roll 43 such as the cleaning shower 44 and/or the high pressure water cleaning shower 47' are arranged in this way. This is advantageous when the felt stretcher roll 43 provides the turning of the felt fabric 41 so that the turning from the negative machine direction −MD to the positive machine direction MD takes place above the forming station A and in the negative machine direction −MD as compared with the center R of the forming roll 12. Other parts of the washing station 42 or indeed the entire washing station 42 may in some embodiments also be arranged in the negative machine direction −MD in relation to the center R of the forming roll.

Lead rolls 48 for leading the felt fabric 41 from the cleaning station 42 to the forming nip 15 of the forming section A may suitably also be provided in the return section D.

The holding structure 65 of the crescent former 1 thus provides an upper level 66 in which at least part of the return section D is arranged and that extends at least partly above the forming section A. The upper level 66 may be arranged at any suitable height above the forming section A but it is advantageous to leave sufficient space above the headbox 11 to allow for maintenance and also to allow for other components that may be arranged in the vicinity of the headbox 11. The upper level 66 may in some embodiments be arranged in steps so that components in the upper level 66 are placed at varying height in the crescent former 1. It is however advantageous that components on the upper level 66 do not extend above the drying section C so that an increase in the total height of the crescent former 1 can be avoided.

The stretcher station 49 may similar to the prior art be placed in the cleaning station 42 and is shown in the Figure together with the felt stretcher roll 43 so that the felt fabric 41 is stretched during cleaning. In the preferred embodiment, the stretcher station 49 is at least partly placed in the negative machine direction −MD in relation to the center R of the forming roll, and this is advantageous since it contributes to the compact design of the crescent former 1. In other embodiments, however, the stretcher station 49 could instead be placed in the positive machine direction MD as compared with the center R of the forming roll and the stretcher station could alternatively also be placed together with the forming section A and the press section B in a level of the holding structure 65 that is lower than the upper level 66.

In some embodiments, the stretcher station 49 may be placed in the negative machine direction −MD of the center R of the forming roll 12, and the felt stretcher roll 43 may be provided either before the stretcher station 49 or after the stretcher station 49. In such embodiments, the stretcher station 49 may comprise a stretcher roll that forms a turning point for the felt fabric 41 on the upper level 66.

Washing of the felt fabric 41 is performed by means of a washing fluid that is applied to the felt fabric 41 as described above. In the preferred embodiment the washing fluid is water but alternatively the washing fluid could be comprise a cleaning agent mixed with water to could be formed by a cleaning agent without requiring dilution with water. It is to be noted that when washing fluid, cleaning fluid/liquid or water is mentioned herein, this is to be interpreted as any liquid or fluid that is suitable for cleaning a felt fabric 41 in a crescent former.

In the return section D, the felt fabric 41 is thus arranged to pass above the forming roll 12 and preferably also other parts of the forming section A on the upper level 66 of the holding structure 65. This is one of the main advantages of the present invention and enables the compact design of the crescent former 1 while still providing all components required for the desired operation of the crescent former 1 so that tissue paper can be produced at a desired quality and as desired production speed.

The cleaning station 42 of the preferred embodiment suitably comprises a tray 64 for collecting water or liquid from the washing station 42. Suitably, the tray 64 is arranged below at least one part of the washing station 42 such as the felt stretcher roll 43 but the tray 64 may alternatively be arranged below the stretching station 49 and collect water that has been applied to the felt fabric 41 before reaching the stretching station 49. By providing the tray 64 in this way it can largely be prevented that water falls down from the cleaning station 42 and/or from the stretching station 49 onto the forming section A and/or onto the floor or other structures in the vicinity of the crescent former 1. It is especially advantageous that the tray 64 collects water or washing fluid/liquid so that contamination of the forming wire 14 is prevented, since any water and/or fibers falling on the forming wire 14 risks significantly lowering quality of the tissue paper produced by the crescent former 1 by forming streaks or dots on the web that is processed to form tissue paper.

The washing station 42 may also comprise a cover 63 arranged at least partly enclose the washing station 42 to capture water or cleaning fluid/liquid and prevent contamination to the forming section A or other parts of the crescent former 1 or the vicinity of the crescent former 1. This is advantageous in preventing contamination on the forming wire 14 and also to decrease the risk of damage or injury to other components and to personnel working in the area since fluid increases the risk of injury from slipping on the floor and since water may cause corrosion or other damage to parts of the crescent former 1 or other machinery in the vicinity. Also, by preventing or at least decreasing the risk of water, cleaning fluid and/or fibers from the crescent former 1 in undesired places in the formers 1 and in the surrounding area, the need for maintenance and cleaning is decreased. Suitably, the cover 63 is arranged around part of the felt stretcher roll 43 and/or the stretcher station 49, but the cover could instead be arranged around any other part of the washing station 42 where water or cleaning fluid is used. In some embodiments, a plurality of covers 63 may be used and/or a cover 63 that at least partly encloses multiple parts of the cleaning station 42 or the entire cleaning station 42 may be used.

It is to be noted that features from the various embodiments described herein may freely be combined, unless it is explicitly stated that such a combination would be unsuitable.

The invention claimed is:

1. A crescent former for producing tissue paper, the crescent former comprising:
- a forming section (A),
- a press section (B), and
- a drying section (C),
- wherein the forming section (A) comprises:
  - a breast roll (13) and a forming roll (12),
  - a forming wire (14), and
  - a headbox (11) for injecting stock into a forming nip (15) formed between the breast roll (13) and forming roll (12),
- wherein the press section (B) comprises a press roll (21)
- wherein the drying section (C) comprises:
  - a Yankee roll (31) arranged to form a press nip (22) with the press roll (21) of the press section (B), wherein the press nip (22) is arranged in a positive machine (MD) direction from the forming nip (15),
- wherein the crescent former further comprises a felt fabric (41) for carrying the stock from the forming nip (15) to the press nip (22), the felt fabric (41) being configured to receive stock from the headbox (11) and be pressed against the forming wire (14) in the forming nip (15), and the felt fabric (41) further being configured to be separated from the forming wire (14) after the forming nip (15) and to carry the stock to the press nip (22) where the stock is transferred to the Yankee roll (31),
- wherein further the felt fabric (41) is configured to be returned from the press nip (22) to the forming nip (15) in a return section (D) such that the felt fabric (41) forms an endless loop,
- wherein the return section (D) comprises a cleaning station (42),
- wherein at least part of the cleaning station (42) being arranged in a negative machine direction (−MD) in relation to a center line (R) of the forming roll (12), said negative machine direction (−MD) being a direction that is opposite to the positive machine direction (MD), and
- the felt fabric (41) is arranged to pass above the forming roll (12) on an upper level (66) of the former in the return section (D) when returning from the press nip (22) to the forming nip (15).

2. The crescent former according to claim 1, wherein the return section (D) also comprises a stretcher station (49), said stretcher station (49) being arranged in the negative machine direction (−MD) in relation to the center line (R) of the forming roll (12) of the forming section (A).

3. The crescent former according to claim 2, further comprising a tray (64) for collecting water from the cleaning station (42), said tray (64) being arranged below a part of the cleaning station (42) but above the forming roll (12).

4. The crescent former according to claim 1, further comprising a first lead roll (61) for leading the felt fabric (41) from the press nip (22) towards the cleaning station (42).

5. The crescent former according to claim 4, further comprising a second lead roll (62) for leading the felt fabric (41) from the first lead roll (61) towards the cleaning station (42).

6. The crescent former according to claim 5, wherein the first lead roll (61) contacts a paper side of the felt fabric (41).

7. The crescent former according to claim 5, wherein the second lead roll (62) contacts a back side of the felt fabric (41).

8. The crescent former according to claim 1, further comprising a cover (63) arranged to at least partly enclose the cleaning station (42) for preventing washing liquid from escaping from the cleaning station (42).

9. A crescent former for producing tissue paper, the crescent former comprising:
- a forming section (A),
- a press section (B), and
- a drying section (C),
- wherein the forming section (A) comprises:
  - a breast roll (13) and a forming roll (12),
  - a forming wire (14), and
  - a headbox (11) for injecting stock into a forming nip (15) formed between the breast roll (13) and forming roll (12),
- wherein the press section (B) comprises a press roll (21)
- wherein the drying section (C) comprises:
  - a Yankee roll (31) arranged to form a press nip (22) with the press roll (21) of the press section (B), wherein the press nip (22) is arranged in a positive machine (MD) direction from the forming nip (15),
- wherein the crescent former further comprises a felt fabric (41) for carrying the stock from the forming nip (15) to the press nip (22), the felt fabric (41) being configured to receive stock from the headbox (11) and be pressed against the forming wire (14) in the forming nip (15), and the felt fabric (41) further being configured to be separated from the forming wire (14) after the forming nip (15) and to carry the stock to the press nip (22) where the stock is transferred to the Yankee roll (31),
- wherein further the felt fabric (41) is configured to be returned from the press nip (22) to the forming nip (15) in a return section (D) such that the felt fabric (41) forms an endless loop,
- wherein the return section (D) comprises a cleaning station (42),
- wherein at least part of the cleaning station (42) being arranged in a negative machine direction (−MD) in relation to a center line (R) of the forming roll (12), said negative machine direction (−MD) being a direction that is opposite to the positive machine direction (MD), and
- wherein the return section (D) also comprises a stretcher station (49), said stretcher station (49) being arranged in the negative machine direction (−MD) in relation to the center line (R) of the forming roll (12) of the forming section (A).

10. The crescent former according to claim 9, further comprising a tray (64) for collecting water from the cleaning station (42), said tray (64) being arranged below a part of the cleaning station (42) but above the forming roll (12).

11. The crescent former according to claim 9, further comprising a first lead roll (61) for leading the felt fabric (41) from the press nip (22) towards the cleaning station (42).

12. The crescent former according to claim 11, further comprising a second lead roll (62) for leading the felt fabric (41) from the first lead roll (61) towards the cleaning station (42).

13. The crescent former according to claim 12, wherein at least one of the first lead roll (61) contacts a paper side of the felt fabric (41) or the second lead roll (62) contacts a back side of the felt fabric (41).

14. The crescent former according to claim 9, further comprising a cover (63) arranged to at least partly enclose the cleaning station (42) for preventing washing liquid from escaping from the cleaning station (42).

15. A crescent former for producing tissue paper, the crescent former comprising:
- a forming section (A),
- a press section (B), and
- a drying section (C),
- wherein the forming section (A) comprises:
  - a breast roll (13) and a forming roll (12),
  - a forming wire (14), and
  - a headbox (11) for injecting stock into a forming nip (15) formed between the breast roll (13) and forming roll (12),
- wherein the press section (B) comprises a press roll (21)
- wherein the drying section (C) comprises:
  - a Yankee roll (31) arranged to form a press nip (22) with the press roll (21) of the press section (B), wherein the press nip (22) is arranged in a positive machine (MD) direction from the forming nip (15),
- wherein the crescent former further comprises a felt fabric (41) for carrying the stock from the forming nip (15) to the press nip (22), the felt fabric (41) being configured to receive stock from the headbox (11) and be pressed against the forming wire (14) in the forming nip (15), and the felt fabric (41) further being configured to be separated from the forming wire (14) after the forming nip (15) and to carry the stock to the press nip (22) where the stock is transferred to the Yankee roll (31),
- wherein further the felt fabric (41) is configured to be returned from the press nip (22) to the forming nip (15) in a return section (D) such that the felt fabric (41) forms an endless loop,
- wherein the return section (D) comprises a cleaning station (42),
- wherein at least part of the cleaning station (42) being arranged in a negative machine direction (−MD) in relation to a center line (R) of the forming roll (12), said negative machine direction (−MD) being a direction that is opposite to the positive machine direction (MD),
- wherein the return section (D) also comprises a stretcher station (49), said stretcher station (49) being arranged in the negative machine direction (−MD) in relation to the center line (R) of the forming roll (12) of the forming section (A), and
- wherein the crescent former further comprises a tray (64) for collecting water from the cleaning station (42), said tray (64) being arranged below a part of the cleaning station (42) but above the forming roll (12).

16. The crescent former according to claim 15, wherein the crescent former further comprises a first lead roll (61) for leading the felt fabric (41) from the press nip (22) towards the cleaning station (42) and a second lead roll (62) for leading the felt fabric (41) from the first lead roll (61) towards the cleaning station (42).

17. The crescent former according to claim 16, wherein the first lead roll (61) contacts a paper side of the felt fabric (41) and the second lead roll (62) contacts a back side of the felt fabric (41).

18. The crescent former according to claim 15, further comprising a cover (63) arranged to at least partly enclose the cleaning station (42) for preventing washing liquid from escaping from the cleaning station (42).

* * * * *